US007354314B1

(12) United States Patent
Sprouse et al.

(10) Patent No.: US 7,354,314 B1
(45) Date of Patent: Apr. 8, 2008

(54) ELECTRICAL CONNECTOR WITH GROUNDING PIN

(75) Inventors: Steven Sprouse, San Jose, CA (US); Ka Ian Yung, Mountain View, CA (US); Suresh Upadhyayula, San Jose, CA (US); Patricio Collantes, San Jose, CA (US)

(73) Assignee: SanDisk Corporation, Milpitas, CA (US)

( * ) Notice: Subject to any disclaimer, the term of this patent is extended or adjusted under 35 U.S.C. 154(b) by 0 days.

(21) Appl. No.: 11/618,084

(22) Filed: Dec. 29, 2006

(51) Int. Cl.
*H01R 24/00* (2006.01)

(52) U.S. Cl. ..... 439/660

(58) Field of Classification Search ..... 439/660, 439/108, 218
See application file for complete search history.

(56) References Cited

U.S. PATENT DOCUMENTS 6,948,983 B1 * 9/2005 Peng ..... 439/660
6,994,568 B2 2/2006 Huang et al.
7,021,971 B2 * 4/2006 Chou et al. ..... 439/660
2004/0038565 A1 2/2004 Yen
2004/0087213 A1 5/2004 Kao
2004/0102093 A1 5/2004 Huang
2005/0042930 A1 * 2/2005 Harkabi et al. ..... 439/660

* cited by examiner

*Primary Examiner*—Tho D. Ta
(74) *Attorney, Agent, or Firm*—Vierra Magen Marcus & DeNiro LLP

(57) ABSTRACT

A semiconductor device is disclosed including a sheathless connector having a grounding pin which protects against electrical shorts and damage upon a backwards insertion of the connector to a host device. If the electrical connector is inserted backwards, the grounding pin mates with the signal ground terminal of the socket, and avoids contact with the remaining terminals. As a result, the damage otherwise occurring upon a backwards insertion of prior art devices is avoided.

24 Claims, 3 Drawing Sheets

ELECTRICAL CONNECTOR WITH GROUNDING PIN

BACKGROUND OF THE INVENTION

1. Field of the Invention

Embodiments of the present invention relate to a sheathless connector having a grounding pin which protects against a short circuit and damage upon a backwards insertion of the connector to a host device.

2. Description of the Related Art

The strong growth in demand for portable consumer electronics is driving the need for high-capacity storage devices. Non-volatile semiconductor memory devices, such as flash memory storage cards, are becoming widely used to meet the ever-growing demands on digital information storage and exchange. Their portability, versatility and rugged design, along with their high reliability and large storage capacity, have made such memory devices ideal for use in a wide variety of electronic devices, including for example digital cameras, digital music players, video game consoles, PDAs and cellular telephones.

Equally ubiquitous is the universal serial bus (USB) interface for transferring signals between devices such as those named above and other components such as for example desktop computers and the like. The USB interface is comprised of a male plug and female socket connectors. Plugs generally have one or more pins that are inserted into openings in the mating socket. While there are several types of USB connectors, the most commonly used is the type-A plug on which is a 4-pin connector, surrounded by a shield. A conventional type-A USB plug and socket are shown in cross-section in prior art FIGS. 1 through 3. The conventional USB plug 20 shown in FIG. 1 may for example be attached to an electronic device and includes a base 22 on which is formed a signal power pin 24, a pair of signal pins 26, 28 and a signal ground pin 30. The base and pins are covered by a shroud 32. As seen in FIG. 2, the conventional USB socket 36 may be incorporated in a host device and includes a base 38 and four terminals 40 through 46 formed thereon (shown in phantom lines for clarity). As seen in FIG. 3, the plug may be received within the socket with pins 24 through 30 mating with pins 40 through 46 to allow transfer of signals between the electronic and host devices.

In conventional USB connections, the shroud provides a grounding path for electrostatic charges in the electronic device to be dissipated. However, some low profile USB connective devices are currently being made without the shroud, such as plug 50 shown for example in prior art FIGS. 4 and 5. In order to provide a path to ground in the absence of a sheath, it is known to include a grounding plate 52 on a side of the base opposite the signal pins for contacting the conductive sides of the socket 36. For example, U.S. Pat. No. 6,896,527, entitled, "Slim USB Male Connector with System Grounding," discloses a USB connective device including signal pins on a first side of the base and a ground plate on the opposite side of the base for providing a path to ground.

However, a drawback to known connectors is that, without a shroud, it is often possible to insert a USB plug into a socket in the wrong orientation, i.e., backwards. That is, as shown in prior art FIG. 6, the plug is inserted so that the pins 24 through 30 face the wrong way. In prior art connectors, such as that disclosed in the '527 patent, a backwards insertion of the plug will result in the plate 52 engaging the power and ground terminals of the host device socket. Connecting the host device grounding terminal with the power terminal via the plate 52 can result in a short circuit and damage to the host device. There is therefore a need of an electrical connector having a grounding path but which does not run the risk of electrical short or damage upon a backward insertion of the connector to a host device.

SUMMARY OF THE INVENTION

One embodiment relates to a semiconductor device including a sheathless connector having a grounding pin which protects against electrical shorts and damage upon a backwards insertion of the connector to a host device. The semiconductor device includes an integrated circuit coupled to the electrical connector. A top portion of the connector may include a plurality of signal pins, including a signal ground pin adjacent a first edge of the connector and connected to a ground plane or circuit of the integrated circuit. A bottom portion of the connector may include a grounding pin adjacent a second edge of the connector and similarly connected to the ground plane or circuit of the integrated circuit.

The semiconductor device may further include a printed circuit board. In embodiments, the signal pins and grounding pin may be formed on the printed circuit board so that the electrical connector is integrally formed with the integrated circuit. In an alternative embodiment, the electrical connector may be formed separately from the printed circuit board and affixed thereto after the connector and printed circuit board are formed.

The electrical connector may be inserted into a socket of a host device having signal terminals including a signal ground terminal as explained in the Background section. When the connector is properly inserted into the socket, the signal pins engage their respective terminals in the socket. Upon proper insertion, the grounding pin in turn engages an electrically conductive surface of the socket, thereby providing a ground path for the semiconductor device. However, if the electrical connector is inserted backwards, the grounding pin mates with the signal ground terminal of the socket, and avoids contact with the remaining terminals. As a result, the damage otherwise occurring upon a backwards insertion of prior art devices is avoided.

DETAILED DESCRIPTION

Embodiments will now be described with reference to FIGS. 7 through 13, which relate to a sheathless connector having a grounding pin which protects against electrical shorts and damage upon a backwards insertion of the connector to a host device. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Figure 1:
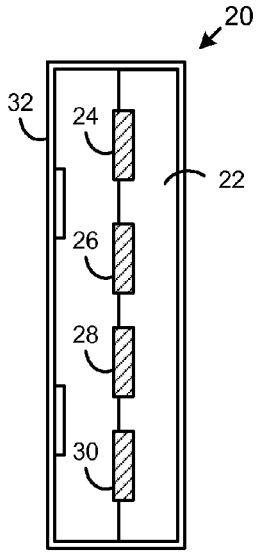
Fig. 1 (Prior Art)
FIG. 1 is a cross-sectional view of a conventional USB plug including a shroud.
Figure 2:
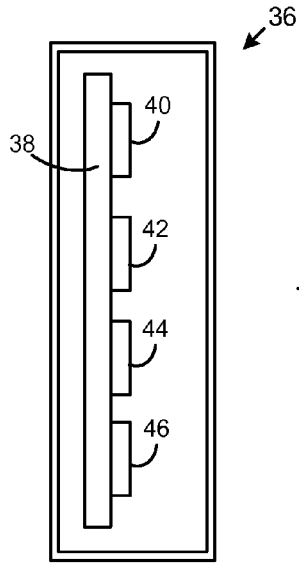
Fig. 2 (Prior Art)
FIG. 2 is a cross-sectional view of a conventional USB socket of a host device.
Figure 3:
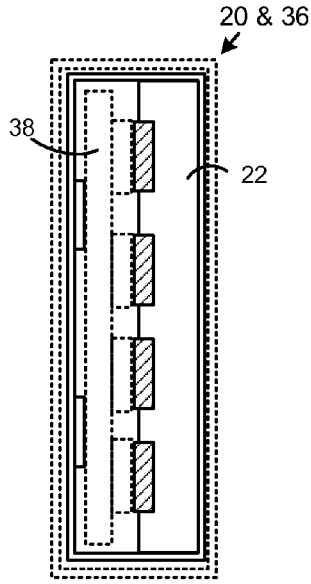
Fig. 3 (Prior Art)
FIG. 3 is a cross-sectional view of a conventional USB plug with shroud mated within a USB socket.
Figure 4:
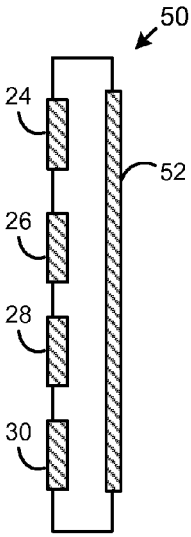
Fig. 4 (Prior Art)
FIG. 4 is a cross-sectional view of a conventional shroudless USB plug.
Figure 5:
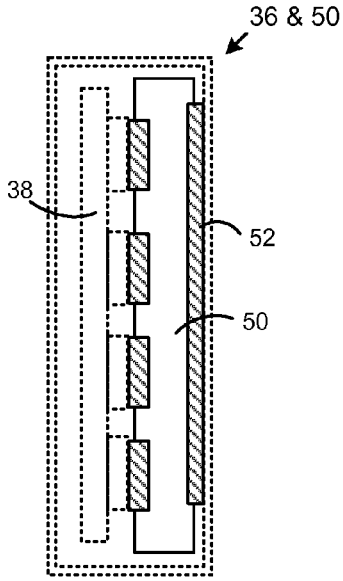
Fig. 5 (Prior Art)
FIG. 5 is a cross-sectional view of a conventional shroudless USB plug within a socket of a host device.
Figure 6:
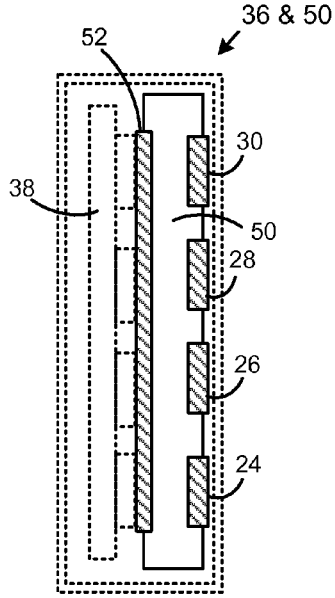
Fig. 6 (Prior Art)
FIG. 6 is a cross-sectional view of a conventional shroudless USB plug inserted backwards into a USB socket of a host device.
Figure 7:
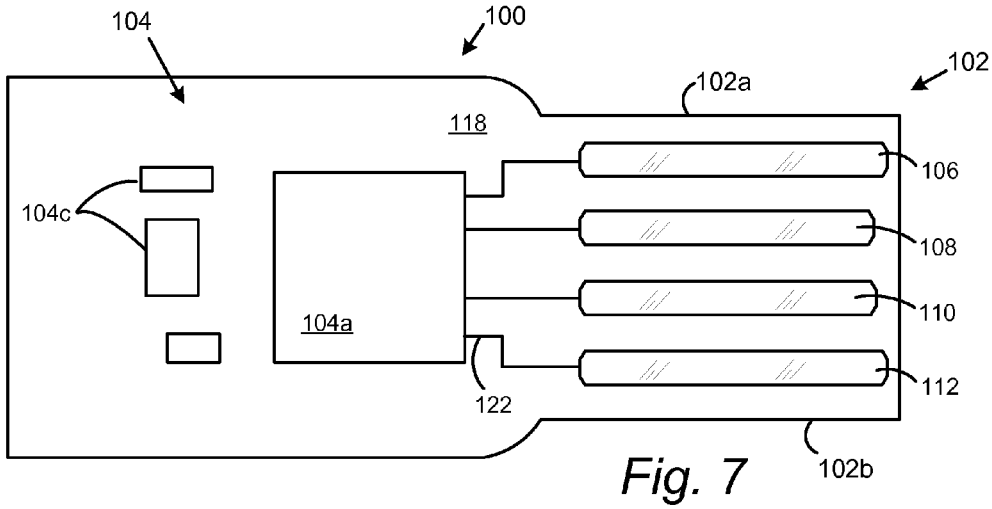
FIG. 7 is a top view of a semiconductor device in accordance with an embodiment of the present invention.
Figure 8:
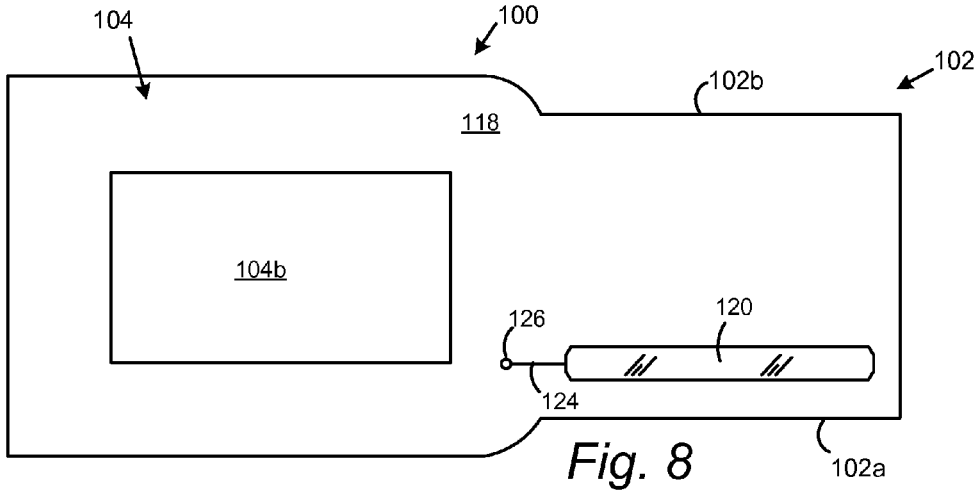
FIG. 8 is a bottom view of a semiconductor device in accordance with an embodiment of the present invention.
Figure 9:
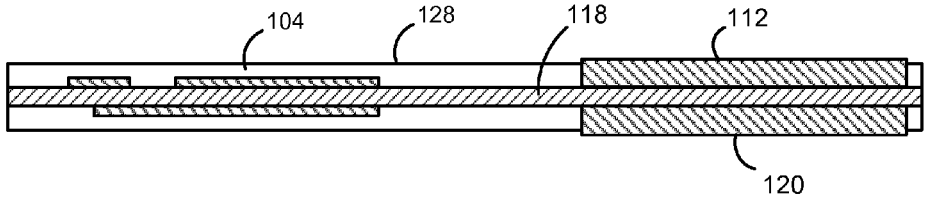
FIG. 9 is a cross-sectional side view of a semiconductor device in accordance with an embodiment of the present invention.

Referring now to the top, bottom and cross-sectional views of FIGS. 7-9, respectively, there is shown a semiconductor device 100 including a USB connector 102 at a first end and an integrated circuit 104 at its second end. Though not critical to the present invention, integrated circuit 104 may include at least semiconductor die 104*a* and 104*b* and passive components 104*c*. The type and function of integrated circuit 104 is again not critical to the present invention, but in embodiments may be a flash memory device including one or more flash memory die and one or more controller die such as an ASIC.

The connector 102 shown is for a type-A USB connection to a host device, but it is contemplated that other types of USB connectors may include the present invention as described hereinafter. The electrical connector 102 includes a first edge 102*a* and a second edge 102*b* opposed to the first edge 102*a*.

As seen in the top view of FIG. 7 and the cross-sectional view of FIG. 9, a top surface of connector 102 includes a plurality of signal pins 106-112. Signal pins 106-112 may be conventional signal pins within a type-A USB connector. Pin 106 may be adjacent to edge 102*a* of the connector and may be a signal power pin for supplying a voltage to a semiconductor device to which USB connector 100 is attached as explained hereinafter. Signal pins 108 and 110 may transmit signals between the semiconductor device and a host device to which USB connector 100 is connected. Pin 112 may be adjacent to edge 102*b* and may be a signal ground pin connected to a ground plane or circuit within integrated circuit 104. The ground plane or circuit provides the semiconductor device 104 with a path to ground. Each of pins 106-112 may be exposed on an upper surface of the semiconductor device 100.

Signal pins 106-112 and integrated circuit 104 may be formed on a printed circuit board ("PCB") 118. As is known in the art, PCB 118 may be formed of a core, having a top conductive layer formed on a top surface of the core, and a bottom conductive layer formed on the bottom surface of the core. During fabrication of the integrated circuit 104 on PCB 118, the conductive layers of the PCB 118 may be etched to define the pins 106-112 on the first surface, and grounding pin 120 (explained below) on the opposite surface. The conductance pattern may further include electrical traces 122 for electrically coupling pins 106-112 to the integrated circuit 104. Once patterned, the PCB 118 may be laminated with a solder mask as is known in the art.

Referring now to the bottom view of FIG. 8 and the cross-sectional view of FIG. 9, in accordance with the present invention, a grounding pin 120 may be formed on PCB 118 adjacent to edge 102, on a side opposite to pins 106-112. The grounding pin 120 may be connected to the ground plane or circuit of integrated circuit 104 in any of various ways, including by a trace 124 and a via 126 formed on PCB 118. Grounding pin 120 may be plated with gold, a nickel/gold alloy or other plating material in a known plating process.

As seen in FIG. 9 but omitted from FIGS. 7 and 8, the PCB 118 may be encapsulated within molding compound 128 in a known encapsulation process. The pins 106-112 on the top surface and the grounding pin 120 on the bottom surface are exposed through the surface of molding compound 128. In alternative embodiments, the integrated circuit 104 and connector 102 may be enclosed within lids or a frame instead of, or in addition to, molding compound 128

In the above-described embodiments, electrical connector 102 is integrally formed as part of printed circuit board 118. In an alternative embodiment to the present invention, electrical connector 102 including signal pins 106-112 and grounding pin 120 may be formed separate from PCB 118. In such an embodiment, after the PCB 118 is formed with integrated circuit 104, the electrical connector may be affixed to the PCB 118. Once affixed, signal pins 106-112 may be soldered to contact pads on PCB 118 to electrically couple pins 106-112 to the integrated circuit. Similarly, grounding pin 120 may be soldered to a contact pad on PCB 118 to electrically couple grounding pin 120 to the ground plane or circuit.

Figure 10:
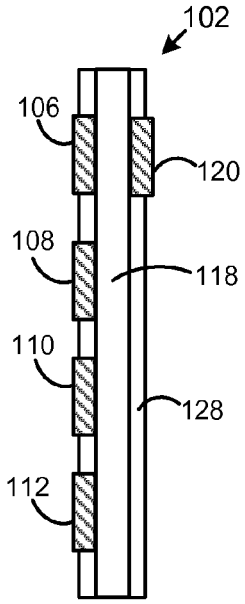
FIG. 10 is a cross-sectional end view of an electrical connector in accordance with an embodiment of the present invention.
Figure 11:
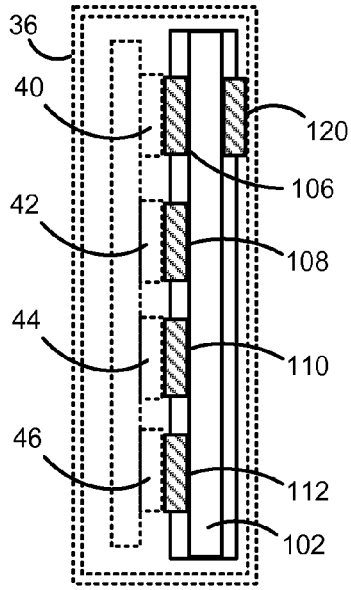
FIG. 11 is a cross-sectional end view of an electrical connector in accordance with an embodiment of the present invention properly inserted within a host device socket.

FIG. 10 is a cross-sectional view of electrical connector 102 showing signal pins 106-112 and grounding pin 120 on printed circuit board 118 within molding compound 122. FIG. 11 is a cross-sectional view of the electrical connector 102 mounted within a conventional socket 36 (as described in the Background section) of a host device. The socket 36 may include signal power terminal 40, signal terminals 42 and 44 and signal ground terminal 46 (socket 36 is shown in phantom lines for clarity).

When properly inserted, pins 106-112 engage terminals 40-46, respectively, as is known in the art to allow the exchange of signals between the semiconductor device 100 and the host device. Similarly, grounding pin 120 engages an electrically conductive surface of socket 36, thereby providing a ground path through the host device for the semiconductor device 100.

Figure 12:
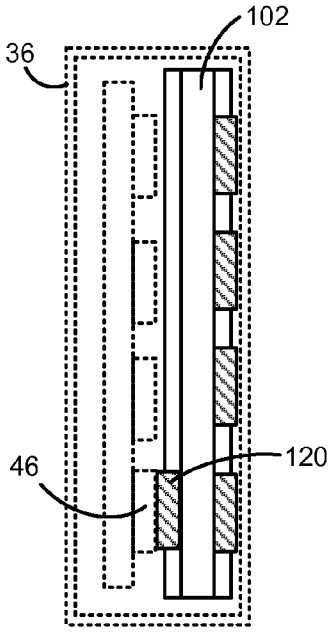
FIG. 12 is a cross-sectional end view of an electrical connector in accordance with an embodiment of the present invention improperly inserted within a host device socket.
Figure 13:
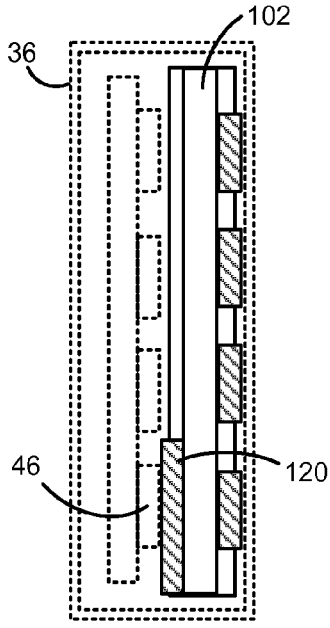
FIG. 13 is a cross-sectional end view of an electrical connector in accordance with an alternative embodiment of the present invention improperly inserted within a host device socket.

However, as explained in the Background section, it may be possible that a low profile USB connector is improperly inserted backwards. Such a situation is illustrated in FIG. 12. As shown, when inserted backwards, the grounding pin 120 mates with signal ground terminal 46, and avoids contact with terminals 40-44. As a result, the damage otherwise occurring upon a backwards insertion of prior art devices is avoided. It is understood that the width of pin 120 (i.e., the dimension extending in between edges 102*a* and 102*b*) may vary in alternative embodiments. For example, as shown in FIG. 13, the width of pin 120 may be greater than the corresponding width of terminal 46. In embodiments, the width may be increased to a point where the grounding pin 120 comes near to, but does not contact, terminal 44.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. An electrical connector for affixing an electronic device to a host device, the electrical connector comprising:

a base including a first and second opposed surfaces, and first and second opposed edges extending between the first and second surfaces;

a signal ground pin on the first surface for connecting the electronic device to ground potential, the signal ground pin positioned adjacent the first edge;

a signal pin on the first surface for transferring signals between the electronic device and the host device, the signal pin positioned adjacent the signal ground pin and spaced a distance from the first edge; and a grounding pin on the second surface for grounding the electronic device, the grounding pin positioned adjacent the second edge and having a width in a direction between the first and second edges, the width being less than the distance the signal pin is spaced from the first edge.

2. An electrical connector as recited in claim 1, wherein the grounding pin is substantially the same size as the signal ground pin.

3. An electrical connector as recited in claim 1, wherein the width of the grounding pin is greater than a width of the signal ground pin.

4. An electrical connector as recited in claim 1, wherein the width of the grounding pin is less than a width of the signal ground pin.

5. An electrical connector as recited in claim 1, the first surface further comprising a second signal pin and signal power pin adjacent the signal pin.

6. An electrical connector as recited in claim 1, wherein the electrical connector is capable of fitting within a USB receptacle of the host device.

7. An electrical connector for affixing an electronic device to a host device, the electrical connector comprising:

a base capable of being oriented in a first orientation and a second orientation rotated 180° from the first orientation, the base including a first surface and a second surface opposite the first surface;

a signal ground pin at a first position on the first surface for connecting the electronic device to ground potential; and a grounding pin on the second surface for grounding the electronic device, the grounding pin occupying a position with respect to the second surface when the base is in the first orientation that is the same as the first position with respect to the first surface when the base is in the second orientation.

8. An electrical connector as recited in claim 7, wherein the electrical connector is capable of fitting within a USB receptacle of the host device.

9. An electrical connector as recited in claim 7, wherein the grounding pin is substantially the same size as the signal ground pin.

10. An electrical connector as recited in claim 7, wherein the grounding pin is larger than the signal ground pin.

11. An electrical connector as recited in claim 7, wherein the grounding pin is smaller than the signal ground pin.

12. An electrical connector as recited in claim 7, wherein the electrical connector is capable of fitting within a USB receptacle of the host device.

13. An electrical connector as recited in claim 7, further comprising a signal pin at a second position on the first surface for communicating signals from the electronic device, and a power pin at a third position on the first surface for receiving a voltage.

14. An electrical connector for affixing an electronic device to a host device, the electrical connector capable of fitting within a receptacle of the host device in first and second orientations, the electrical connector having a plurality of signal pins including a signal ground pin, the signal ground pin capable of mating with a corresponding ground terminal of a plurality of terminals within the host device receptacle when the electrical connector is inserted into the host device receptacle in the first orientation, the electrical connector comprising:

a grounding pin coupled to the electronic device, the grounding pin capable of mating with an electrically conductive portion of the receptacle when the electrical connector is inserted into the receptacle in the first orientation, and the grounding pin capable of engaging the ground terminal of the receptacle without engaging the remaining terminals of the plurality of terminals when the electrical connector is inserted into the receptacle in the second orientation.

15. An electrical connector as recited in claim 14, wherein the grounding pin is the same size as the signal ground pin.

16. An electrical connector as recited in claim 14, wherein the grounding pin has a smaller length and/or width than a length and width of the signal ground pin.

17. An electrical connector as recited in claim 14, wherein the grounding pin has a larger length and/or width than a length and width of the signal ground pin.

18. An electrical connector as recited in claim 14, wherein the electrical connector is capable of fitting within a USB receptacle in the host device.

19. An electrical connector adapted to be received within a receptacle of a host device, the receptacle formed at least in part of an electrical conductor, the electrical connector comprising:

a base including a first surface and a second surface opposed to the first surface, the base capable of fitting within the receptacle in first and second orientations with respect to the receptacle;

a plurality of signal pins formed at discrete positions across the first surface of the base, the plurality of signal pins connected to an electronic device, and capable of mating with respective terminals of a corresponding plurality of terminals within the receptacle when the base is fit within the receptacle in the fist orientation to transfer signals between the electronic device and the host device, the plurality of signal pins including a signal ground pin for mating with a ground terminal of the plurality of terminals within the receptacle; and a grounding pin formed on the second surface of the electrical connector and coupled to the electronic device, the grounding pin capable of mating with an electrically conductive portion of the receptacle when the electrical connector is inserted into the receptacle in the first orientation, and the grounding pin capable of engaging the grounding terminal of the receptacle without engaging the remaining terminals of the plurality of terminals when the electrical connector is inserted into the receptacle in the second orientation.

20. An electrical connector as recited in claim 19, further comprising:

a pair of signal pins of the plurality of signal pins for transferring signals between the electronic device and host device, the pair of signal pins capable of mating with a pair of signal terminals in the receptacle upon connection of the connector to the receptacle in the first orientation; and a power signal pin of the plurality of signal pins, the power signal pin capable of mating with a power signal terminal in the receptacle upon connection of the connector to the receptacle in the first orientation.

21. A flash memory device capable of operating with a host device via a USB receptacle of the host device, the flash memory device comprising:

an electronic device; and an electrical connector capable of fitting within the USB receptacle of the host, the electrical connector including:

a base including a first and second opposed surfaces, and first and second opposed edges extending between the first and second surfaces, a signal ground pin on the first surface for connecting the electronic device to ground potential, the signal ground pin positioned adjacent the first edge, a signal pin on the first surface for transferring signals between the electronic device and host device, the signal pin positioned adjacent the signal ground pin and spaced a distance from the first edge, and a grounding pin on the second surface for grounding the electronic device, the grounding pin positioned adjacent the second edge and having a width less than the distance the signal pin is spaced from the first edge.

22. An electrical connector as recited in claim 21, wherein the grounding pin is substantially the same size as the signal ground pin.

23. An electrical connector as recited in claim 21, wherein the width of the grounding pin is greater than a width of the signal ground pin.

24. An electrical connector as recited in claim 21, wherein the width of the grounding pin is less than a width of the signal ground pin.

* * * * *